US006292091B1

(12) United States Patent
Kambara et al.

(10) Patent No.: US 6,292,091 B1
(45) Date of Patent: Sep. 18, 2001

(54) RESISTOR AND METHOD OF ADJUSTING RESISTANCE OF THE SAME

(75) Inventors: Shigeru Kambara; Toshihiro Teramae, both of Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/621,621

(22) Filed: Jul. 21, 2000

(30) Foreign Application Priority Data

Jul. 22, 1999 (JP) ..... 11-207681
Jul. 30, 1999 (JP) ..... 11-216505

(51) Int. Cl.[7] ..... H01C 10/00
(52) U.S. Cl. ..... 338/195; 338/287; 338/307; 29/620
(58) Field of Search ..... 338/195, 287, 338/288, 289, 292, 307, 309; 29/610.1, 620

(56) References Cited

U.S. PATENT DOCUMENTS

| | | | | |
|---|---|---|---|---|
| 2,953,764 | * | 9/1960 | Tellkamp | 338/309 |
| 3,161,850 | * | 12/1964 | Klug | 338/195 |
| 3,512,254 | * | 5/1970 | Jenkins et al. | 29/620 |
| 3,564,475 | * | 2/1971 | Tatsuo | 338/195 |
| 3,778,744 | * | 12/1973 | Brandi | 338/260 |
| 3,849,757 | * | 11/1974 | Khammous et al. | 338/320 |
| 4,146,867 | * | 3/1979 | Blangeard et al. | 338/195 |
| 4,146,957 | * | 4/1979 | Toenshoff | 338/195 |
| 4,242,660 | * | 12/1980 | Cocca | 338/195 |
| 4,306,217 | * | 12/1981 | Solow | 338/195 |
| 4,375,056 | * | 2/1983 | Baxter et al. | 338/195 |
| 4,429,298 | * | 1/1984 | Oberholzer | 338/195 |
| 4,529,958 | * | 7/1985 | Person et al. | 338/195 |
| 4,794,367 | * | 12/1988 | Ashe et al. | 338/195 |
| 5,206,623 | * | 4/1993 | Rochette et al. | 338/195 |
| 5,754,092 | * | 5/1998 | Ishida et al. | 338/195 |
| 5,815,065 | | 9/1998 | Hanamura | 338/309 |
| 6,007,755 | * | 12/1999 | Hoshii et al. | 338/195 |
| 6,084,502 | * | 7/2000 | Ariga et al. | 338/195 |

FOREIGN PATENT DOCUMENTS

| | | | | |
|---|---|---|---|---|
| 3021288 | * | 12/1981 | (DE) | 338/195 |
| 1321602 | * | 12/1989 | (JP) | 338/195 |

OTHER PUBLICATIONS

Kiang et al. "Fold. Patt. Filim Resist. w. Trimm. Elem. in Bin. Seq." IBMTDB, V.25, N. 4, 2003, Sep. 1982.*
Gow et al. "Thin Film HIgh Aspect Ratio Trim Bar Resistor" IBMTDB V.21, No. 9, 3601, Feb. 1979.*

* cited by examiner

*Primary Examiner*—Karl D. Easthom
(74) *Attorney, Agent, or Firm*—Michael D. Bednarek; Shaw Pittman LLP

(57) ABSTRACT

A resistor includes an insulating substrate, a resistive layer formed on the substrate, and first and second terminal electrodes connected to the resistive layer. The resistive layer is divided into at least a first portion of greater resistance and a second portion of smaller resistance. The first portion is closer to the first terminal electrode than the second portion is. A trimming groove is formed in the second portion for adjustment of the resistance of the resistor.

9 Claims, 9 Drawing Sheets

RESISTOR AND METHOD OF ADJUSTING RESISTANCE OF THE SAME

BACKGROUND OF THE INVENTION

1. Field of the Invention

The present invention relates to a resistor of the type which includes an insulating substrate and a resistor layer formed on the substrate. The present invention also relates to a method of adjusting the resistance of such a resistor.

2. Description of the Related Art

Conventionally, resistors of the above type have been widely used e.g. for manufacturing various kinds of electric appliances. An example of such resistors is shown in FIG. 13 of the accompanying drawings. The conventional device includes a rectangular substrate 20 made of e.g. a ceramic material, an elongated resistor layer 21 formed on the substrate, a pair of terminal electrodes 22, and a protection cover (not shown) for protecting the resistor layer 21 and the terminal electrodes 22. In the resistor layer 21, a trimming groove 23 is formed for adjusting the resistance of the device. The conventional device is mounted on a printed circuit board (not shown) with the terminal electrodes 22 soldered to the wiring pattern of the circuit board.

The trimming groove 23 of the conventional device is provided at a longitudinally central portion of the resistor layer 21. Due to this arrangement, the conventional device has the following disadvantage.

Specifically, the trimming groove 23 causes the central portion of the resistor layer 21 to have a higher resistance than the remaining portions of the resistor layer. Thus, in use, much heat (Joule heat) will be generated at the central portion of the resistor layer 21 other than the remaining portions of the layer. In an extreme case, most of the heat may be generated only at the central portion of the layer 21 ("localization of heat generation"). According to the conventional arrangement, however, the heat at the central portion of the layer 21 cannot be effectively conducted to the wiring pattern of the circuit board via the terminal electrodes 22, since the central portion of the layer 21 is located apart from these terminal electrodes. As a result, Joule heat may build up at the central portion of the resistor layer 21, which is disadvantageous for maintaining the proper function as a resistor.

SUMMARY OF THE INVENTION

It is, therefore, an object of the present invention to provide a resistor by which the above-described problem of localization of heat generation is overcome.

Another object of the present invention is to provide a resistor in which adjustment of resistance by laser trimming is accurately performed.

Still another object of the present invention is to provide a method of adjusting the resistance of a resistor.

According to a first aspect of the present invention, there is provided a resistor which includes: an insulating substrate; a resistive layer formed on the substrate and divided into at least a first portion of greater resistance and a second portion of smaller resistance; and first and second terminal electrodes connected to the resistive layer. The first portion is closer to the first terminal electrode than the second portion is.

With such an arrangement, the localization of heat generation is advantageously overcome since the first portion of greater resistance is arranged closer to the first terminal electrode than the second portion is.

Preferably, the second portion of smaller resistance is formed with a trimming groove for resistance adjustment. In this manner, the resistance adjustment is performed more finely than when the trimming groove is formed in the first portion of greater resistance.

According to a preferred embodiment, the first portion may have a wavy configuration. In this manner, the effective length (i.e., the length measured along the wavy path) of the first portion can be rendered sufficiently long even in a rather small area.

Preferably, the resistive layer may be provided with a bypass element connected to the first portion of the resistive layer for enabling optional adjustment of the resistance of the resistor.

In a preferred embodiment, the first portion is provided with a plurality of turns at which the bypass element is connected to the first portion.

Preferably, the resistive layer may include a third portion whose resistance is greater than the resistance of the second portion. The third portion may be arranged adjacent to the second terminal electrode for facilitating heat conduction from the third portion to the second terminal electrode.

Preferably, each of the first and the third portions may have a wavy configuration.

In a preferred embodiment, the resistor of the present invention may further comprise first and second sets of connection bumps, wherein the first set of connection bumps are connected to the first terminal electrode, while the second set of connection bumps are connected to the second terminal electrode.

Preferably, the resistor of the present invention may further comprise a protection cover formed on the substrate to cover the resistive layer and the terminal electrodes. In this case, the connection bumps are arranged to protrude from the protection cover for establishing connection to an external component.

In a preferred embodiment, the second portion of the resistive layer may have a strip-like configuration.

In another preferred embodiment, the second portion of the resistive layer may have a lattice-like configuration.

The second portion may be trimmed in an L-shaped manner, a crank-shaped manner, a spiral manner, etc.

According to a second aspect of the present invention, there is provided a resistor comprising: an insulating substrate; a resistive layer formed on the substrate; first and second terminal electrodes formed on the substrate; and first and second connectors to connect the resistive layer to the first and the second terminal electrodes, respectively. The resistive layer has a lattice-like configuration for enabling the user to perform accurate adjustment of the resistance of the resistor.

Preferably, the resistive layer may include a plurality of first segments extending in one direction and a plurality of second segments extending in another direction perpendicular to said one direction.

According to a third aspect of the present invention, there is provided a method of adjusting resistance of a resistor. The method may comprise the steps of: forming a resistive layer provided with a lattice-like portion which includes a plurality of first segments extending in one direction and a plurality of second segments extending in another direction perpendicular to said one direction; and trimming at least one of the first and the second segments.

Preferably, the trimming may be performed first for rough adjustment of resistance and then for finer adjustment of resistance. For achieving this, the lattice-like portion may be trimmed in an L-shaped manner. Further, the resistive layer may include a wavy portion provided with a bypass element, and this bypass element is to be selectively trimmed for resistance adjustment.

Other features and advantages of the present invention will become apparent from the detailed description given below with reference to the accompanying drawings.

DETAILED DESCRIPTION OF THE PREFERRED EMBODIMENTS

The preferred embodiments of the present invention will be described below with reference to the accompanying drawings.

Figure 1:
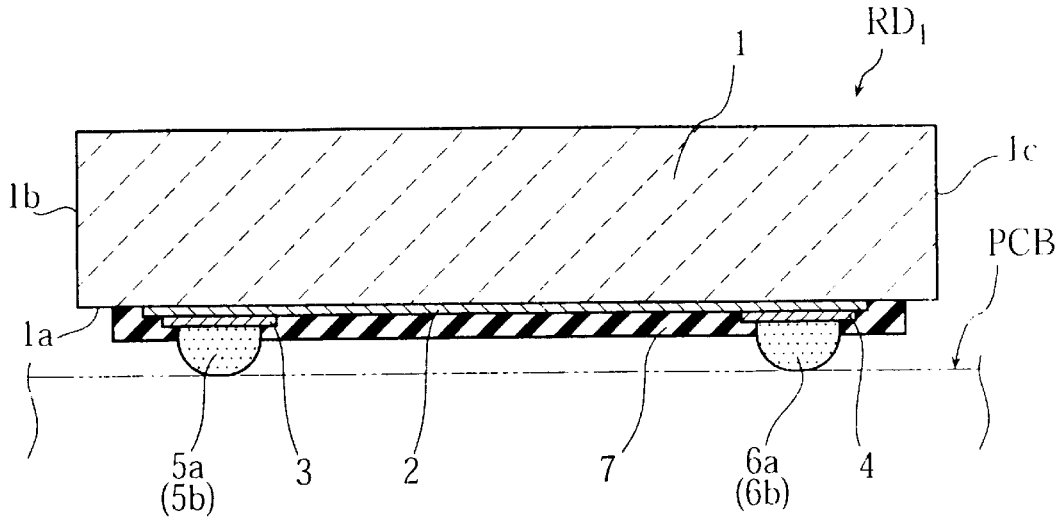
FIG. 1 is a sectional side view showing a resistor according to a first embodiment of the present invention.
Figure 2:
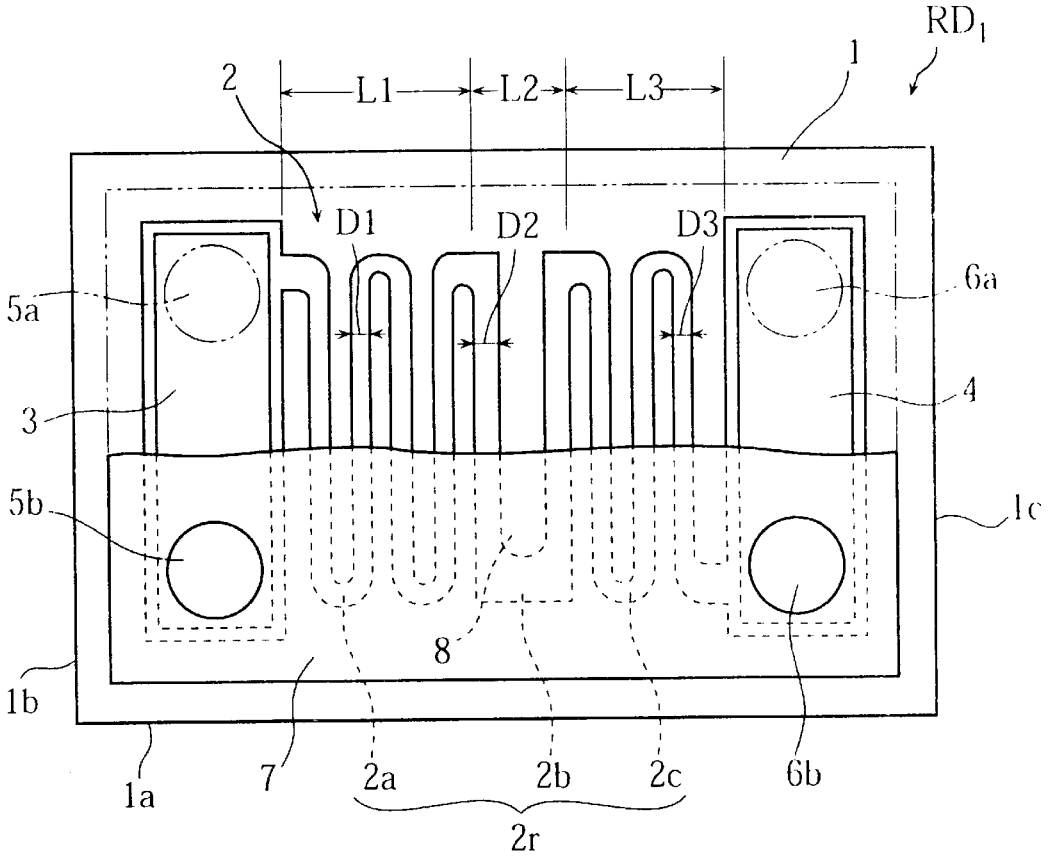
FIG. 2 is a bottom view showing the arrangement of the resistive layer of the resistor of FIG. 1.

Reference is first made to FIGS. 1 and 2 illustrating a resistor RD1 according to a first embodiment of the present invention. The resistor RD1 includes, among other things, a heat-resistant, insulating substrate 1 made of a ceramic material. The substrate 1 is a rectangular solid having a principal surface (lower surface) la upon which a thin resistive pattern 2 is formed. The resistive pattern 2 is made of nickel-chromium alloy. Instead, use may be made of nickel-copper alloy or tantalum or the like for forming the resistive pattern 2.

As best shown in FIG. 2, the resistive pattern 2 extends between a side surface 1*b* of the substrate 1 and the opposite side surface 1*c*. The resistive pattern 2 may be formed in the following manner. First, a thin resistor layer is formed all over the principal surface 1*a* by e.g. sputtering or vacuum evaporation of nickel-chromium alloy. Then, the resistor layer is subjected to photoetching to be made into the desired pattern.

The resistor RD1 also includes first and second electrode layers 3 and 4 made of a highly conductive metal such as copper. The first electrode layer 3 is arranged adjacent to the side surface 1*b* of the substrate 1, while the second electrode layer 4 adjacent to the opposite side surface 1*c*. These layers may be formed by sputtering or vacuum evaporation of the material metal and then subjecting the obtained thin layer to photoetching.

As best shown in FIG. 2, two (first and second) terminal bumps 5*a* and 5*b* are formed on the first electrode layer 3. Likewise, another two (third and fourth) terminal bumps 6*a* and 6*b* are formed on the second electrode layer 4. The first and the fourth bumps 5*a*, 6*b* are used together for current or voltage measurement, while the second and the third bumps 5*b*, 6*a* are used together for voltage or current measurement. These bumps may be made of tin (Sn) or solder for example.

A protection cover 7, which may be made of a heat-resistant synthetic resin or glass, is formed on the principal surface 1*a* of the substrate 1 to cover the resistive pattern 2 and the two electrode layers 3, 4. The protection cover 7 allows the terminal bumps 5*a*–6*b* to protrude therefrom. With such an arrangement, the illustrated resistor is soldered to a printed circuit board (PCB) via the terminal bumps 5*a*–6*b*.

As shown in FIG. 2, the resistive pattern 2 is provided with an intermediate section 2*r* arranged between the first and the second electrode layers 3, 4. This intermediate section 2*r*, which serves as a substantial resisting section, is divided into three portions: a first high-resistance portion 2*a*, a low-resistance portion 2*b* and a second high-resistance portion 2*c*. The low-resistance portion 2*b* is disposed between the first and the second high-resistance portions 2*a*, 2*c*, as viewed longitudinally of the substrate 1. Each of the first and the second high-resistance portions 2*a*, 2*c* serves as a connector for connecting the low-resistance portion 2*b* to the first electrode layer 3 or second electrode layer 4.

The three resistance portions 2*a*–2*c* have a nominal length L1, L2 and L3, respectively. As seen from FIG. 2, the length L1 is the greatest of the three, the length L3 is between the other two, and the length L2 is the least (i.e., L1>L3>L2). The first high-resistance portion 2*a* is formed into a zigzag or wavy path having three complete turns. Similarly, the second high-resistance portion 2*c* is formed into another zigzag or wavy path having two complete turns. The low-resistance portion 2*b*, which initially had a rectangular configuration, is formed with a trimming groove 8 for adjustment of the overall resistance of the resistor.

The first high-resistance portion 2*a* has a width D1, the low-resistance portion a width D2, and the second high-resistance portion 2*c* a width D3. In the illustrated embodiment, the width D2 is greater than the other two widths D1 and D3 which are equal to each other (i.e., D2>D1=D3). As readily seen from FIG. 2, the effective length of the first high-resistance portion 2*a* (that is, the length measured along the zigzag path of the portion 2*a*) is greater than the effective length of the low-resistance portion 2*b*. Also, the effective length of the second high-resistance portion 2*c* is greater than that of the low-resistance portion 2*b* but smaller than that of the first high-resistance portion 2*a*. These facts show that in terms of resistance, the first high-resistance portion 2*a* is the greatest, the second high-resistance portion 2*c* the second greatest, and the low-resistance portion 2*b* the least.

It should be noted that the trimming groove 8 is formed in the positionally middle portion 2*b*, which has the lowest resistance of the three portions 2*a*–2*c*. In this manner, the adjustment of the overall resistance of the resistor can be performed more accurately or more finely than is conventionally possible, since the trimming groove formed in the low-resistance portion is less effective in increasing the overall resistance of the resistor than a trimming groove formed in a higher-resistance portion.

Further, with the arrangement illustrated in FIG. 2, Joule heat is generated more in the first and second high-resistance portions 2*a,* 2*c* than in the low-resistance portion 2*b*. Thus, according to the present invention, the conventional problem of localized heat generation is overcome.

Still further, advantageously the heat generated in the first and the second high-resistance portions 2*a,* 2*c,* is efficiently conducted to the printed circuit board via the first or second terminal bumps 5*a*–6*b* , since these high-resistance portions are close to these terminal bumps 5*a*–5*b* or 6*a*–6*b*.

In the illustrated embodiment, the first and the second high-resisting portions 2*a,* 2*c* have a wavy configuration. The present invention, however, is not limited to this. For instance, each high-resistance portion may be rendered straight. In such an instance, the high-resisting portions 2*a,* 2*c* may be made of a material exhibiting higher resistivity than the material used for making the low-resistance portion 2*b*.

Figure 3:
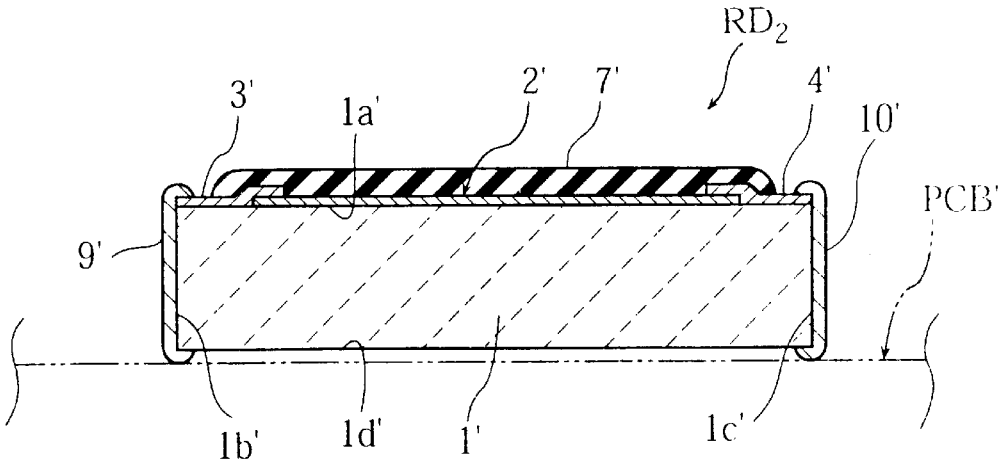
FIG. 3 is a sectional side view showing a resistor according to a second embodiment of the present invention.

Reference is now made to FIG. 3 illustrating a resistor RD2 according to a second embodiment of the present invention. As in the resistor RD1 of the first embodiment described above, the resistor RD2 includes an insulating substrate 1', a resistive pattern 2' formed on the principal surface 1*a*' of the substrate 1', a first electrode layer 3', a second electrode layer 4' and a protection cover 7'.

Differing from the first embodiment, the first and the second electrode layers 3', 4' partially protrude from the protection cover 7' to a side surface 1' of the substrate 1' or to the opposite side surface 1'. The exposed portion of the first electrode layer 3' is connected to a first terminal 9' formed on the left side surface 1'. The exposed portion of the second electrode layer 4' is connected to a second terminal 10' formed on the opposite or right side surface 1'. The resistor RD2 is mounted on a printed circuit board PCB' with its bottom surface 1*d*' facing the circuit board. The first and the second terminals 9', 10' are soldered to the wiring pattern (not shown) formed on the circuit board.

Figure 4:
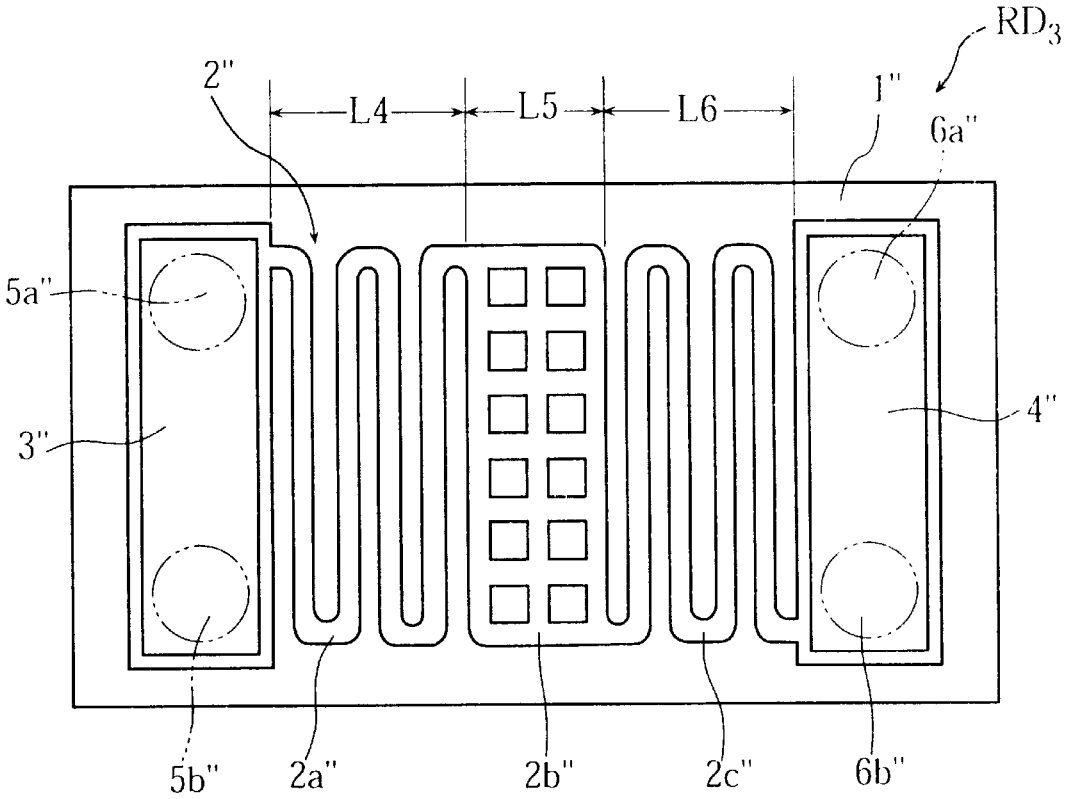
FIG. 4 is a bottom view showing the arrangement of the resistive layer of a resistor according to a third embodiment.

FIG. 4 is a bottom view showing a resistor RD3 according to a third embodiment of the present invention. The resistor RD3 is basically similar to the resistor RD1 of the first embodiment. As illustrated, the resistor RD3 includes a rectangular insulating substrate 1", a resistive pattern 2", a first electrode layer 3", a second electrode layer 4", a pair of terminal bumps 5*a*", and 5*b*", another pair of terminal bumps 6*a*" and 6*b*", and a protection cover (not shown) for covering the resistive pattern 2" and the electrode layers 3", 4".

The resistive pattern 2" is divided into three portions: a first high-resistance portion 2*a*", a low-resistance portion 2*b*" and a second high-resistance portion 2*c*". These three portions 2*a*"–2*c*" have a nominal length L4, L5 and L6, respectively. In the illustrated embodiment, the length L4 is equal to the length L6 and greater than the length L5 (i.e., L4=L6>L5).

The biggest difference between the two resistors RD3, RD1 is the arrangement of the low-resistance portions 2*b*", 2*b*. While the low-resistance portion 2*b* (FIG. 2) has a simple, strip-like configuration (prior to the formation of the trimming groove 8), the low-resistance portion 2*b*" has a lattice-like configuration, as shown in FIGS. 4, 5.

Figure 5:
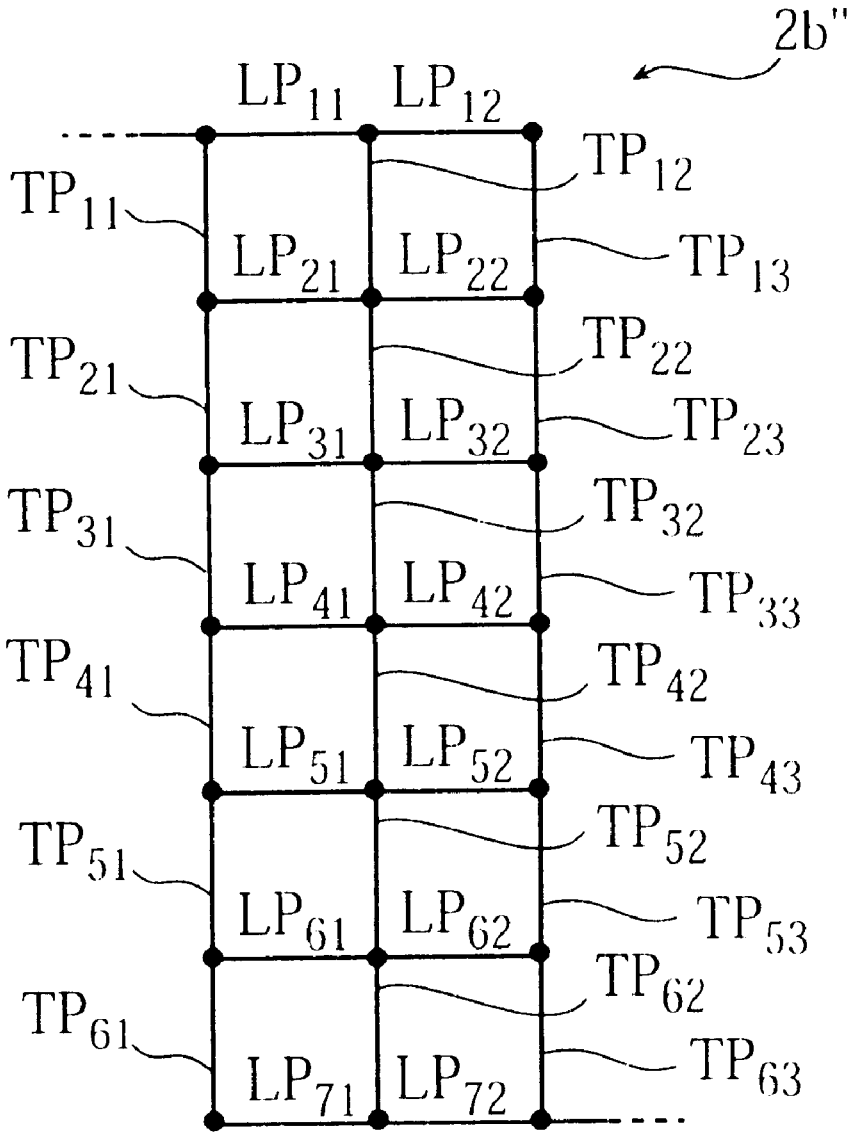
FIG. 5 is a schematic diagram showing the structure of the lattice-like resistive portion of the resistor of FIG. 4.

More specifically, referring to FIG. 5, the low resistance portion 2*b*" of the third embodiment consists of 14 longitudinal paths (or segments) $LP_{ij}$ ($1 \leqq i \leqq 7$, $1 \leqq j \leqq 2$) extending longitudinally of the substrate 1", and 18 transverse paths (or segments) $TP_{xy}$ ($1 \leqq x \leqq 6$, $1 \leqq y \leqq 3$) extending widthwise of the substrate 1".

Figure 6:
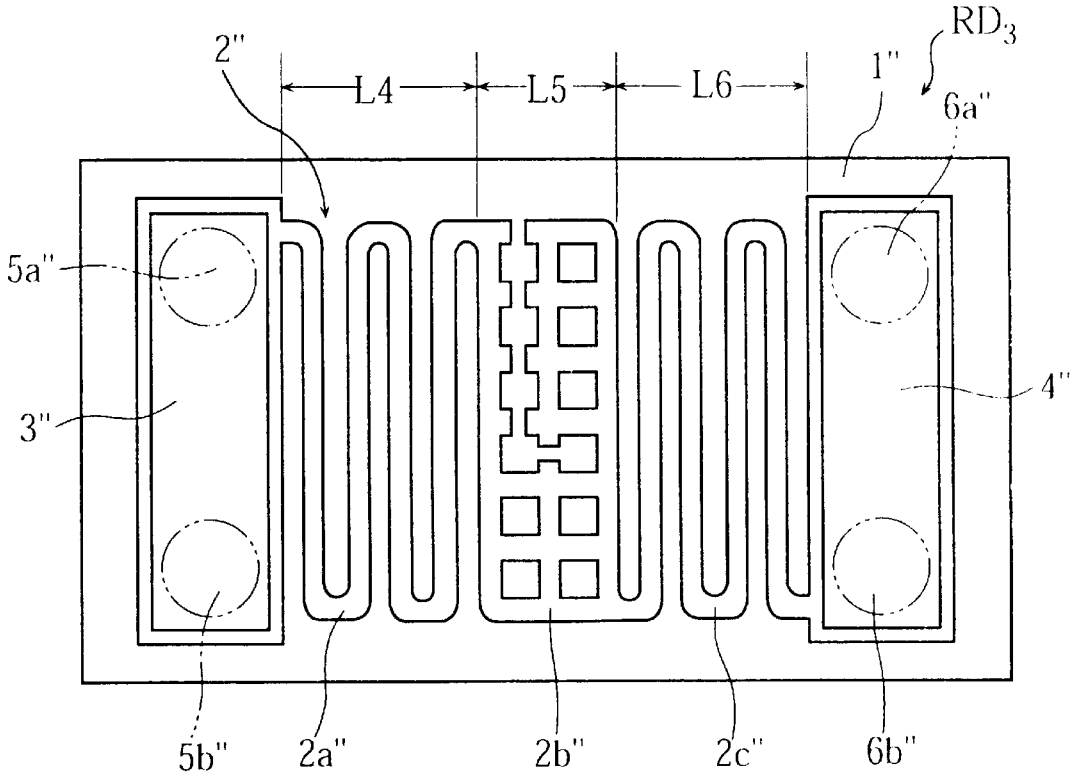
FIG. 6 shows an example of how the lattice-like resistive portion is trimmed for resistance adjustment.

Each of the longitudinal paths and the transverse paths has a prescribed resistance. In this regard, all of the longitudinal and transverse paths may have the same resistance, or they may have different resistances. As readily seen, the overall resistance of the resistive pattern 2" can be altered by selectively cutting (trimming) these paths. For instance, four longitudinal paths LP11, LP21, LP31, LP41 and one transverse path TP42 may be trimmed by a laser beam. The result is shown in FIG. 6.

As the laser-trimming proceeds, the resistive pattern 2" will exhibit higher resistances. Thus, for achieving the desired resistance in the pattern 2", it is necessary to stop the trimming operation before too many paths of the low-resistance portion 2*b*" have been cut. To this end, the resistance of the resistive pattern 2" is constantly monitored by using a measuring device (not shown) connected to the resistive pattern during the laser-trimming operation.

Figure 8:
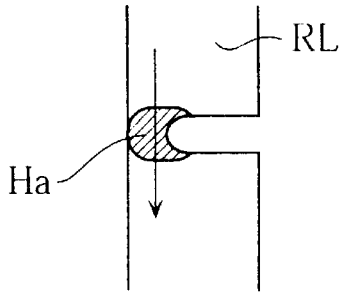

It should be noted that the measurement of resistance of a resistor in general tends to be thermally affected and therefore show different values depending on the temperature of the portion to be measured. In this connection, reference is first made to FIG. 8 which illustrates an example where the resistance measured during a laser trimming process and the resistance measured after completion of the trimming are different from each other. In this case, as shown in FIG. 8, current is caused to flow through the hatched area Ha which is adjacent to the end of the trimming groove formed in the layer RL. The hatched area Ha is heated up during the laser trimming and then cools down to e.g. room temperature after the laser trimming is over. Thus, the resulting resistance of the layer RL after the laser trimming may be different from the monitored resistance of the layer RL during the laser trimming. This means that it is difficult or even impossible to obtain the required resistance of the layer RL if the resistance of the layer RL is constantly monitored during the laser trimming operation.

Figure 7:
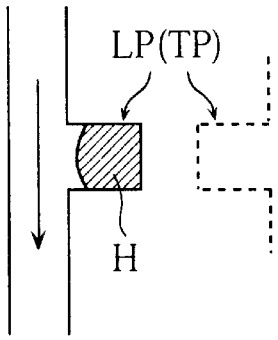
FIGS. 7 and 8 illustrate how heated areas of resistive layers affect the passage of current.

The above problem is advantageously overcome with the resistor RD3 of the present invention. Referring to FIG. 7, a longitudinal path LP (or transverse path TP) of resistor RD3 is cut at a central portion thereof by a laser beam. Thus, the heated area H due to the laser trimming does not expand into the passage of an electric current. In this case, it is possible to perform a reliable resistance adjustment for the resistive pattern.

Figure 9:
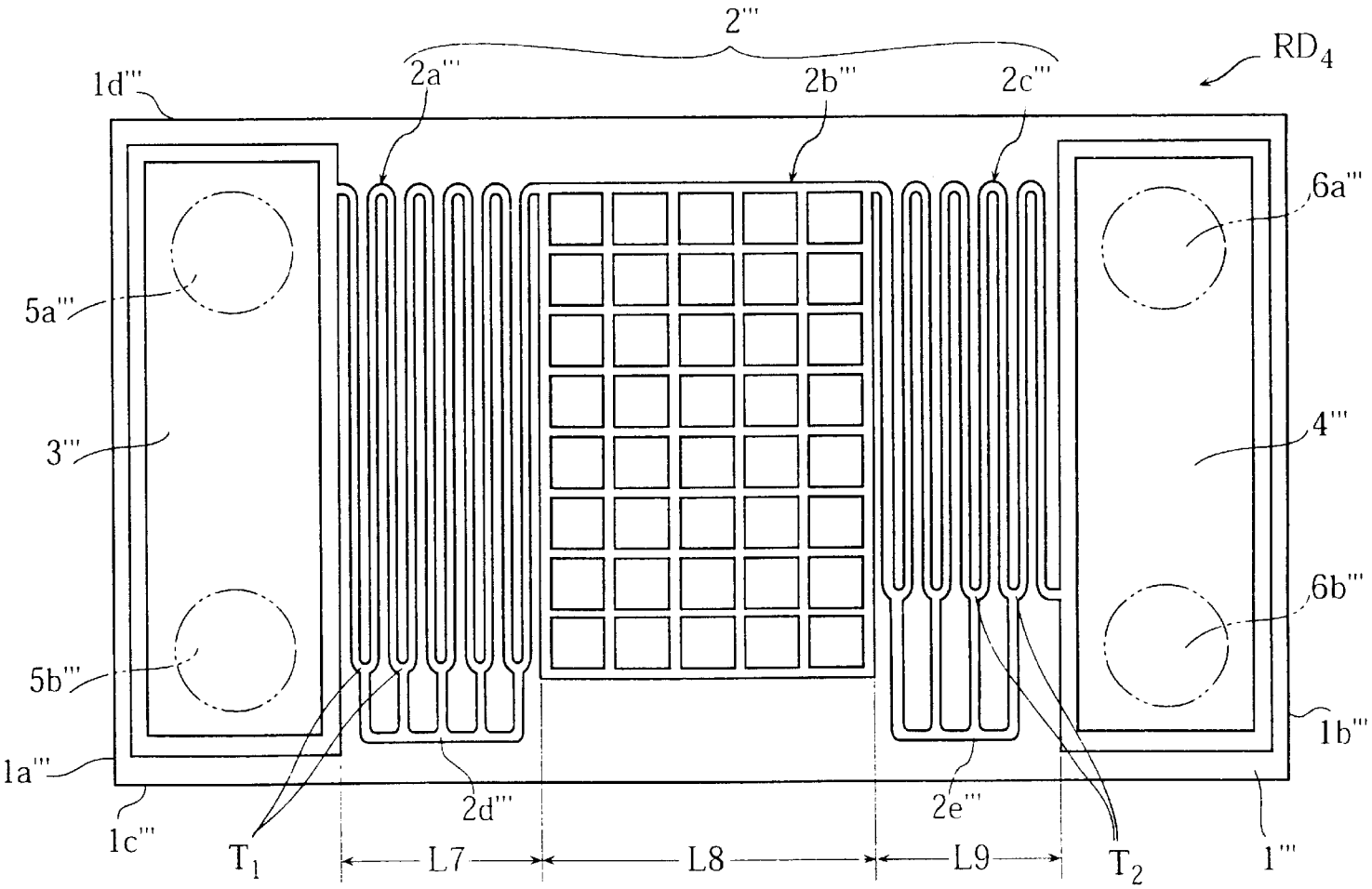
FIG. 9 is a bottom view showing a resistor according to a fourth embodiment of the present invention.

Reference is now made to FIG. 9 illustrating a resistor RD4 according to a fourth embodiment of the present invention. The resistor RD4 of this embodiment is basically similar to the resistor RD3 of the third embodiment (FIG. 4) except for the arrangement of the resistive pattern 2'''.

Specifically, as in the resistor RD3, the resistor RD4 includes a rectangular insulating substrate 1''' provided with a first shorter edge 1*a*''', a second shorter edge 1*b*''' opposite to the first shorter edge 1*a*''', a first longer edge 1*c*''' and a second longer edge 1*d*''' opposite to the first longer edge 1*c*'''. The resistor RD3 also includes a resistive pattern 2''', first and second electrode layers 3'''–4''', a pair of terminal bumps 5*a*'''–5*b*''' and another pair of terminal bumps 6*a*'''–6*b*'''. Though not illustrated, a protection cover is formed on the substrate 1''' to cover the resistive pattern 2''' and the two electrode layers 3'''–4'''.

The resistive pattern 2''' is divided into three portions: a first high-resistance portion 2*a*''', a lattice- or grid-like low-resistance portion 2*b*''', and a second high-resistance portion 2*c*'''. The first high-resistance portion 2*a*''' is arranged closer to the first shorter edge 1*a*''', while the second high-resistance portion 2*c*''' closer to the second shorter edge 1*b*'''. The low-resistance portion 2*b*''' is arranged between the first and the second high-resistance portions 2*a*''', 2*c*'''. The first high-resistance portion 2*a*''' has a nominal length L7, the low-resistance portion 2*b*''' a nominal length L8, and the second high-resistance portion 2*c*''' a nominal length L9. In the illustrated example, the nominal length L8 is the greatest of the three, the nominal length L7 is the second, and the nominal length L9 is the least.

The first and the second high-resistance portions 2*a*''', 2*c*''' are formed into a zigzag path, as in the previous embodiments. The zigzag path of the first high-resistance portion 2*a*''' has five turns T1 closer to the first longer edge 1*c*''' than to the opposite edge 1*d*'''. Likewise, the zigzag path of the second high-resistance portion 2*c*''' has four turns T2 closer to the first longer edge 1*c*'''.

Differing from the previous embodiments, the zigzag path of the first high-resistance portion 2*a*''' is provided with a bypass element 2*d*''', for connecting the five turns T1 to each other. To this end, the bypass element 2*d*''', includes five, mutually connected comb-like teeth each of which is connected to an appropriate one of the five turns T1. The resistivity of the bypass element 2*d*''' may be equal to or greater or smaller than the resistivity of the first high-resistance portion 2*a*'''.

Similarly, the zigzag path of the second high-resistance portion 2*c*''' is provided with a bypass element 2*e*''' for connecting the four turns T2 to each other. The bypass element 2*e*''' includes four, mutually connected comb-like teeth each of which is connected to an appropriate one of the four turns T2.

With the above-described arrangements, the overall resistance of the resistor RD4 may be adjusted by trimming the low-resistance portion 2*b*''' and optionally by trimming the first and/or the second bypass elements 2*d*''', 2*e*'''. The trimming for these elements can be performed in various manners, as described below.

Figure 10:
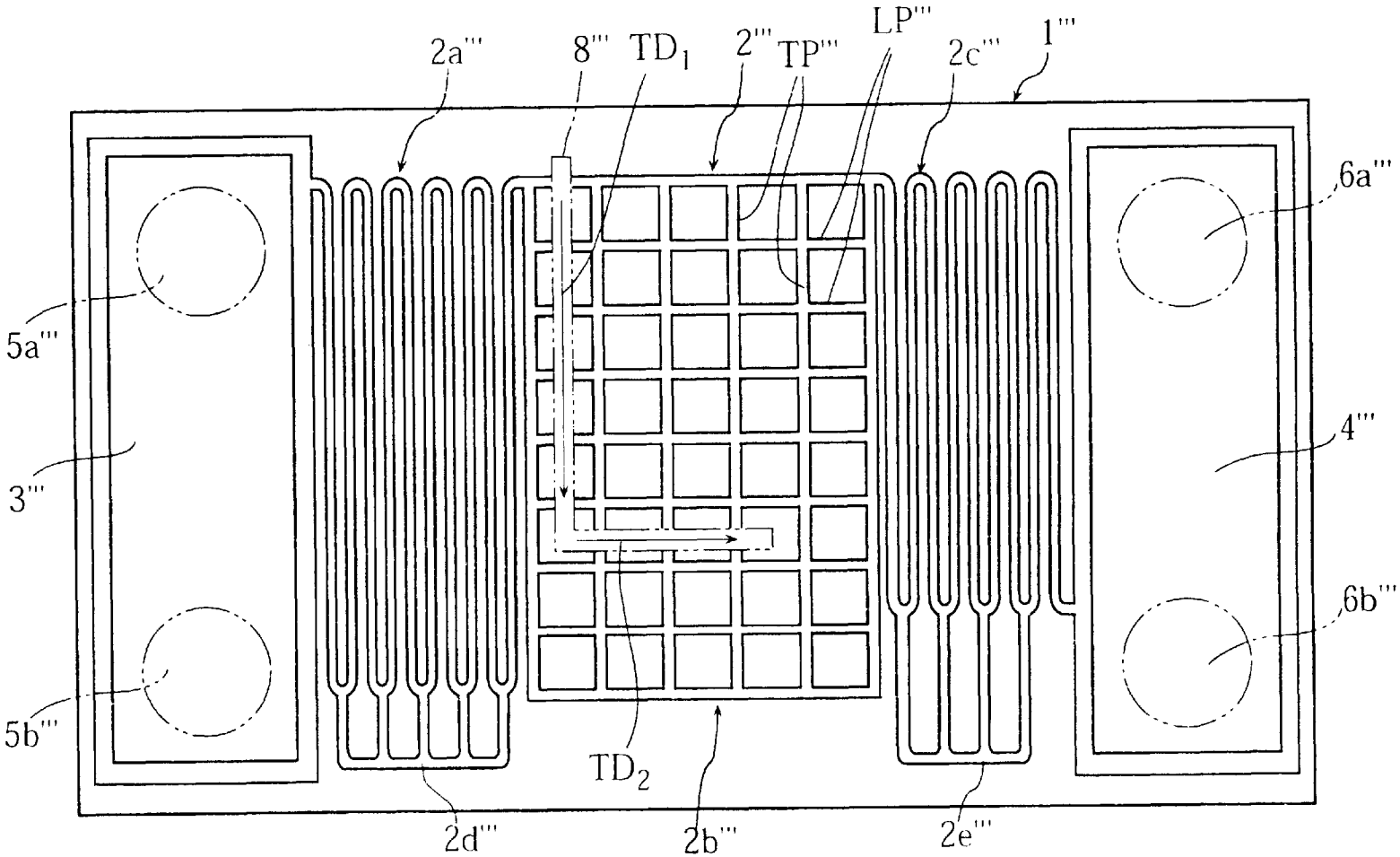
FIGS. 10–12 show examples of how the lattice-like resistive portion of the resistor of FIG. 9 is trimmed for resistance adjustment.

One example is shown in FIG. 10 in which an L-shaped trimming groove 8''' is formed in the low-resistance portion 2*b*''' for cutting a certain number of the longitudinal paths LP''' and transverse paths TP'''. As shown by two arrows TD1 and TD2, the trimming is performed by first moving a laser beam widthwise of the substrate 1''' (first step), and then moving it longitudinally of the substrate (second step). In this manner, the resistance of the low-resistance portion 2''' can be adjusted roughly at the first step, and then more finely at the second step.

Figure 11:
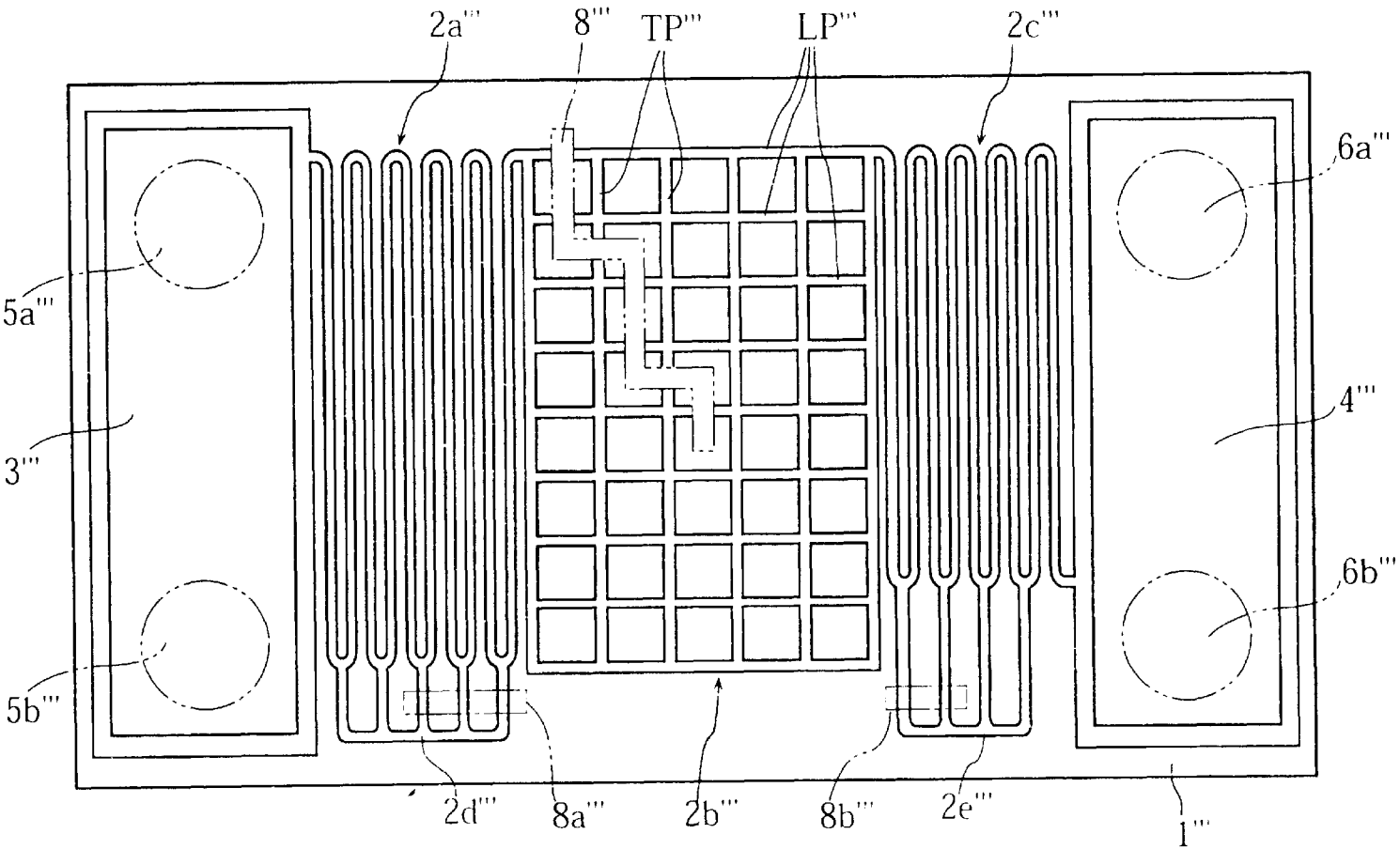

FIG. 11 shows another example of possible trimming pattern. In this example, a crank-like laser-trimming groove 8''' is formed in the low-resistance portion 2*b*''' Further, as for the first and the second bypass elements 2*d*''', 2*e*''', a straight trimming groove 8*a*''' or 8*b*''' may be formed for cutting some or all of the comb-like teeth of the bypass elements 2*d*''', 2*e*'''.

Figure 12:
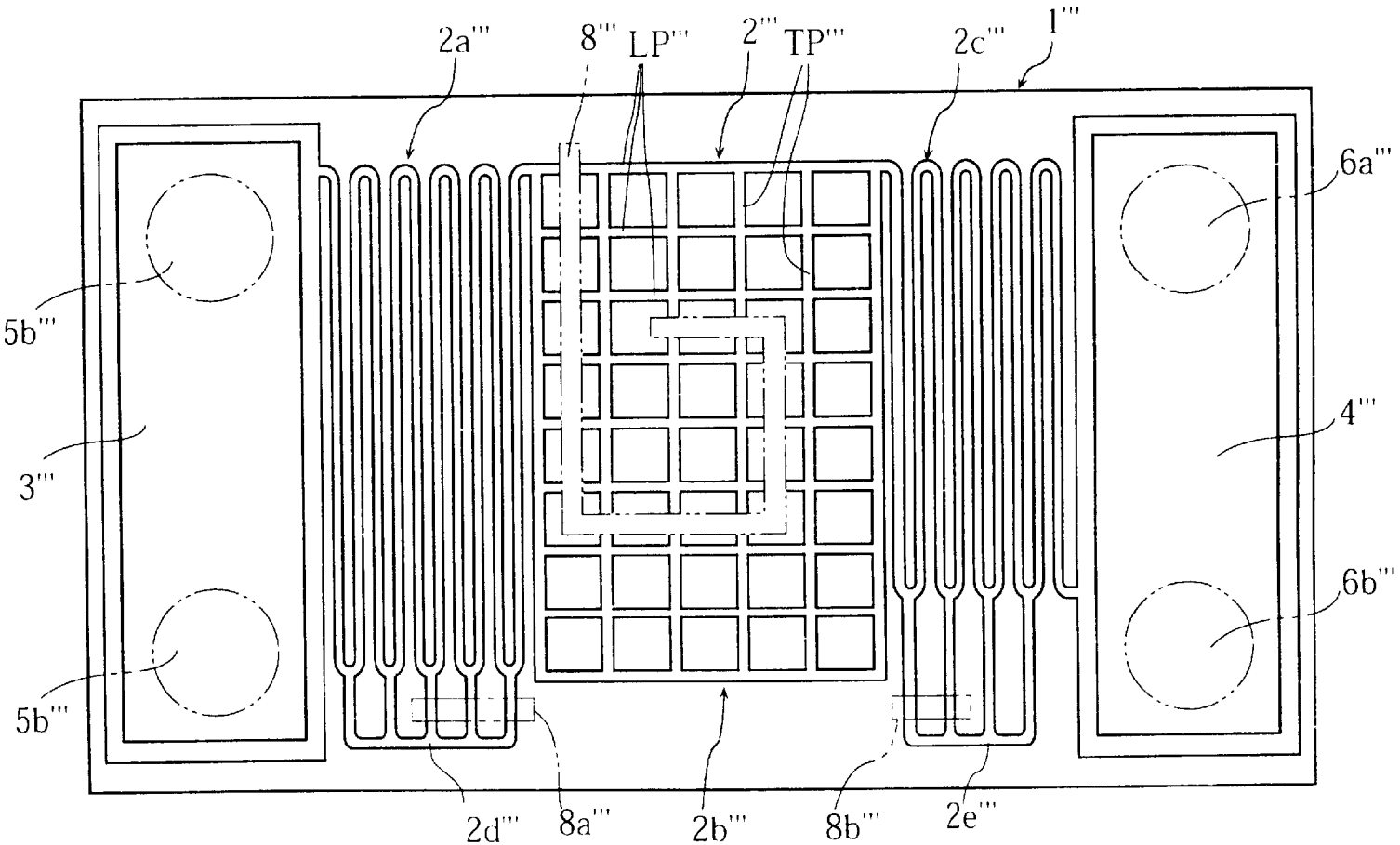
Figure 13:
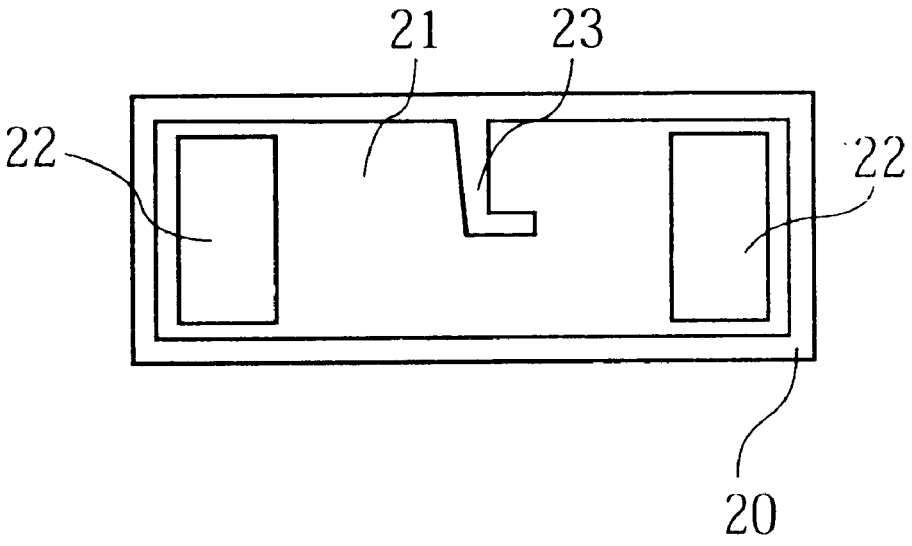
FIG. 13 PRIOR ART
FIG. 13 is a plan view showing a conventional resistor provided with a substrate and a trimmed resistive layer formed on the substrate.

FIG. 12 shows still anther example of possible trimming pattern. In this example, a spiral trimming groove 8''' is formed in the low-resistance portion 2'''.

In the above-described embodiments, the respective resistive patterns (2, 2', 2'', 2''') are formed as a thin layer made by e.g. sputtering or vacuum evaporation. Instead, it is also possible to make these resistive patterns as a thick layer by using e.g. screen-printing.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. A resistor comprising:

an insulating substrate;

a resistive layer formed on the substrate, the resistive layer including a first higher-resistance wavy portion, a second higher-resistance wavy portion, and a lower-resistance portion having a lattice configuration arranged between the first and the second higher-resistance wavy portions;

a first terminal electrode connected to the first higher-resistance wavy portion; and a second terminal electrode connected to the second higher-resistance wavy portion;

wherein the first and the second higher-resistance resistance wavy portions generate more heat than the lower-resistance portion; and wherein the lower-resistance portion is trimmed in a crank shape.

2. A resistor comprising:

an insulating substrate;

a resistive layer formed on the substrate, the resistive layer including a first higher-resistance wavy portion, a second higher-resistance wavy portion, and a lower-resistance portion having a lattice configuration arranged between the first and the second higher-resistance wavy portions;

a first terminal electrode connected to the first higher-resistance wavy portion; and a second terminal electrode connected to the second higher-resistance wavy portion;

wherein the first and the second higher-resistance wavy portions generate more heat than the lower-resistance portion; and wherein the lower-resistance portion is trimmed in a spiral shape.

3. The resistor according to claim 1 or 2, wherein each of the first and the second higher-resistance wavy portions includes a plurality of turns which are connected directly to a bypass element.

4. The resistor according to claim 3, wherein the bypass element is provided with a trimming groove.

5. The resistor according to claim 1 or 2, wherein each of the first and the second terminal electrodes is provided with a plurality of bumps, one bump of the first terminal electrode and one bump of the second terminal electrode being provided for current measurement, another bump of the first terminal electrode and another bump of the second terminal electrode being provided for voltage measurement.

6. A method of adjusting resistance of a resistor, comprising the steps of:

providing an insulating substrate;

providing a resistance layer formed on the substrate, the resistor layer including a first higher-resistance wavy portion, a second higher-resistance wavy portion, and a lower-resistance portion arranged between the first and the second higher-resistance wavy portions;

providing a first terminal electrode connected to the first higher-resistance wavy portion; and providing a second terminal electrode connected to the second higher-resistance wavy portion, wherein the first and the second higher-resistance wavy portions generate more heat than the lower-resistance portion and wherein the lower-resistance portion has a lattice structure which includes a plurality of first segments extending in one direction and a plurality of second segments extending in another direction perpendicular to said one direction; and trimming at least one of the first and the second segments, wherein the trimming is performed in a crank-shape.

7. A method of adjusting resistance of a resistor, comprising the steps of:

providing an insulating substrate;

providing a resistance layer formed on the substrate, the resistor layer including a first higher-resistance wavy portion, a second higher-resistance wavy portion, and a lower-resistance portion arranged between the first and the second higher-resistance wavy portions;

providing a first terminal electrode connected to the first higher-resistance wavy portion; and providing a second terminal electrode connected to the second higher-resistance wavy portion, wherein the first and the second higher-resistance wavy portions generate more heat than the lower-resistance portion and wherein the lower-resistance portion has a lattice structure which includes a plurality of first segments extending in one direction and a plurality of second segments extending in another direction perpendicular to said one direction; and trimming at least one of the first and the second segments, wherein the trimming is performed in a spiral shape.

8. The method according to claim 6 or 7, wherein the trimming is performed first for rough adjustment of resistance and then for finer adjustment of resistance.

9. The method according to claim 6 or 7, wherein each of the first and the second higher-resistance wavy portions includes a plurality of turns which are connected directly to a bypass element, and wherein the bypass element is additionally trimmed for resistance adjustment.

* * * * *